United States Patent [19]

Opderbeck

[11] 4,305,682

[45] Dec. 15, 1981

[54] SOIL COMPACTING ROLLER FOR CONFINED AREAS

[75] Inventor: Rudolph G. Opderbeck, Waukesha, Wis.

[73] Assignee: Wacker Corporation, Milwaukee, Wis.

[21] Appl. No.: 126,559

[22] Filed: Mar. 3, 1980

[51] Int. Cl.[3] ..... E01C 19/26

[52] U.S. Cl. ..... 404/122; 180/20; 172/540

[58] Field of Search ..... 404/122, 121, 123, 124, 404/125, 126, 127, 128; 180/20; 172/540, 539, 554; 280/125, 126, 127, 130

[56] References Cited

U.S. PATENT DOCUMENTS

| | | | |
|---|---|---|---|
| 2,197,183 | 4/1940 | Keeler | 404/129 |
| 2,428,281 | 9/1947 | Jones | 280/125 X |
| 2,759,739 | 8/1956 | Walsh | 280/126 X |
| 2,925,759 | 2/1960 | Hillis | 404/122 |
| 3,119,313 | 1/1964 | Neidhardt | 404/125 |
| 3,153,993 | 10/1964 | Keppler | 404/117 |
| 3,161,250 | 12/1964 | Gardner | 180/20 X |
| 3,228,312 | 1/1966 | Neidhardt | 404/125 |
| 3,319,545 | 5/1967 | Seaman | 404/125 |
| 3,395,626 | 8/1968 | Garis | 404/117 |
| 4,192,626 | 3/1980 | Wyckoff | 404/123 |

OTHER PUBLICATIONS

"Engineering News-Record", Mar. 7, 1957, p. 74.

*Primary Examiner*—Nile C. Byers, Jr.
*Attorney, Agent, or Firm*—James E. Nilles

[57] ABSTRACT

A very maneuverable soil compacting roller for use in a confined area comprises a frame, a compacting drum freely rotatable about a horizontal axis near one end of the frame, and a pair of coaxial wheels near the other end of the frame, for propulsion and steering. The wheels are maintained in coaxial spaced apart relation by axle means with which they are drivingly connected, and the axle means is confined to rotation relative to an axle housing between the wheels. A drive motor is secured to the axle housing. The unit comprising axle housing and drive motor has a connection with a steering bracket which rotates relative to the frame about a vertical steering axis, and said connection provides for swinging of said unit about an axis which is mutually perpendicular to the wheel axis and the steering axis so that the wheels can move up and down to accommodate terrain irregularities.

5 Claims, 5 Drawing Figures

SOIL COMPACTING ROLLER FOR CONFINED AREAS

FIELD OF THE INVENTION

This invention relates to compacting roller machines of the type comprising a cylindrical drum which rotatably supports a frame on which an operator rides and through which compacting force is imposed upon a surface traversed by the machine; and the invention is more particularly concerned with a compacting roller which is especially suited for soil compaction and for operation in a relatively confined area.

BACKGROUND OF THE INVENTION

There are many situations in which soil must be compacted in a relatively confined area, as for example when a foundation has been laid for a building and the soil in the area surrounded by the foundation wall needs to be compacted, as a preparation for laying a concrete floor.

A compacting roller machine that is suitable for such a job must be extremely maneuverable, and the drum through which it exerts compacting force should be so arranged in relation to the frame of the machine that the drum can be brought as close as possible to foundation walls and similar obstructions. It will be evident to those familiar with the compacting roller art that the requirements just specified imply a relatively small machine having a relatively short frame and a small turning radius.

In theory it might seem as if some of the relatively large roller machines that have heretofore been developed and marketed would be satisfactory for use in confined areas if they were merely scaled down. Some such rollers have had articulated frames comprising front and rear frame members connected to swing relative to one another about a vertical axis, and usually such a roller had a cylindrical drum at its front and drive wheels at its rear. The articulated connection between the frame members was employed to avoid having either the wheels or the drum arranged to be steerable relative to the frame, thus enabling both the steering mechanism and the propulsion drive to be simplified. A scaled-down version of such a machine would lack the maneuverability needed for operation in confined areas because its articulated frame members could swing only about 40° in each direction, and therefore such a roller would not have a small enough turning radius.

Smaller rollers have been produced that had two drums, one of which was steerable relative to the frame and the other of which was rotatably driven for propulsion of the machine. Such two-drum machines have usually been employed for rolling asphalt paving material or the like. Because the steerable drum could swing to only a limited extent about its vertical steering axis, such a machine—like an articulated-frame roller—had too large a turning radius to be satisfactory for use in confined places. However, even if designed for a small turning radius, such a machine would be unsatisfactory for use on any surface that did not afford good traction to its rotatably driven drum. A roller intended for soil compaction can of course be expected to encounter very uneven and irregular surfaces on which a steel propulsion drum would slip and slide very badly.

Thus the problem of providing a roller machine that is satisfactory for soil compacting in a confined area is actually a compex of problems. The machine must be relatively small, but it must nevertheless be capable of operating on a very irregular surface. It must have a very small turning radius, but the mere provision of a short turning radius does not afford the required maneuverability and controllability if the machine does not have good propulsive traction on irregular surfaces, or if it has a tendency to skid and slide instead of moving in the direction in which it is steered. And of course the desired controllability, maneuverability and traction should not be achieved at the sacrifice of capability for efficient soil compaction.

The conventional cylindrical steel roller drum obviously cannot afford as much traction as a pair of wheels equipped with high-traction tires, but the wheels, to be effective, must both be in contact with the surface at all times, even though the surface is very irregular. If the wheels are to maintain such surface contact, they must be capable of at least limited up and down movement relative to one another and to the frame of the machine, and heretofore it has not been obvious how the wheels could be mounted for such independent up and down movement and still be rotatably driven by an arrangement that was simple and compact enough for a small machine and at the same time sturdy enough for a soil compacting machine. To these difficult requirements must be added the further complication that the wheel drive mechanism should preferably also accommodate steering motions of the wheels relative to the frame, since control is more effective if the wheels are steered rather than the drum.

SUMMARY OF THE INVENTION

The general object of the present invention is to provide a compacting roller which is particularly suited for soil compacting and for operation in confined areas and which, in furtherance of this objective, has good propulsive traction, a small turning radius and excellent controllability.

Another and more specific object of the invention is to provide a roller machine having a cylindrical drum near one end of its frame by which soil compaction is effected, and having a pair of coaxial wheels near the other end of its frame, each equipped with a high-traction tire and by which propulsion is imparted to the machine, said machine having a simple steering arrangement that affords it a short turning radius but also ensures that both of the wheels will at all times have good traction, even on a very irregular surface.

Another specific object of the invention is to provide a roller compacting machine of the character described that has a roller which effects compaction and has a pair of wheels which are rotatably driven to effect propulsion of the machine, said wheels being both steerable and movable up and down relative to the machine frame so that they can accommodate themselves to irregularities in terrain traversed by the machine and thus be effective to propel the machine and control its direction of motion.

It is thus a further specific object of the invention to provide a simple but sturdy arrangement for drive wheels of a roller compacting machine whereby propulsion torque can be imposed upon the drive wheels notwithstanding that they are steerable relative to the machine frame and are independently movable up and down.

In general, these objects of the invention are achieved in a soil compacting roller comprising a frame, a cylindrical drum which is rotatable about a horizontal axis near one end of the frame and by which compacting force is imposed upon a surface traversed by the roller, and a pair of coaxial wheels which cooperate with said roller to support the frame and which provide for propulsion and steering of the roller. The soil compacting roller of this invention is characterized by a steering bracket connected with the frame to pivot relative thereto about a substantially vertical axis near the other end of the frame; an axle housing; axle means rotatable in said axle housing and having coaxial portions which project in opposite horizontal directions from the axle housing and to which the wheels are respectively secured; swivel joint means providing a connection between the axle housing and the steering bracket whereby the axle housing is confined to swinging motion relative to the steering bracket about an axis which is substantially horizontal and is transverse to the axis of said portions of the axle means, so that the wheels can swing up and down to accommodate themselves to terrain irregularities and can be steered by rotation of the steering bracket about said vertical axis; and drive means supported on the axle housing and drivingly connected with the axle means to rotatably drive the wheels for propulsion of the roller.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
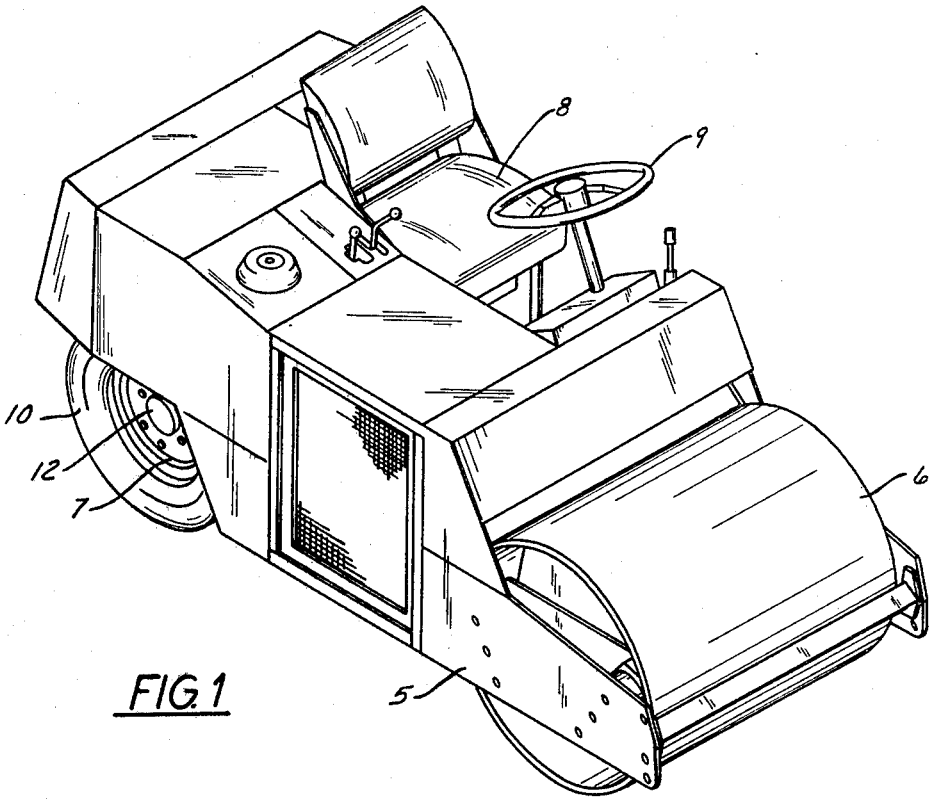
FIG. 1 is a top perspective view of a soil compacting roller embodying the principles of this invention.
Figure 4:
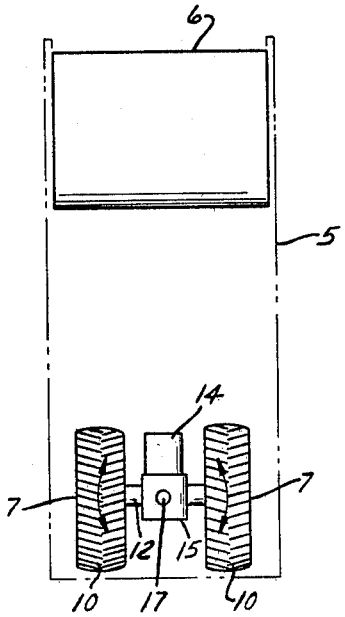
FIG. 4 is a more or less diagrammatic plan view showing the relationship of the wheels and the drum to one another in the machine of this invention.
Figure 5:
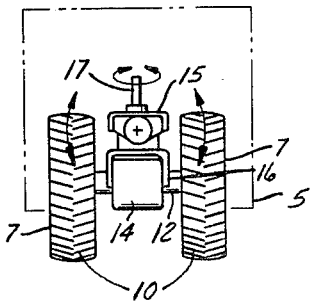
FIG. 5 is a diagrammatic view of the roller machine in rear elevation, showing the movements that the wheels can make for steering and for accommodation to terrain irregularities.

Referring now to the accompanying drawings, a compacting roller (FIG. 1) embodying the principles of this invention comprises a substantially rigid frame or chassis 5 which is supported on a cylindrical compacting drum 6 at the front of the frame and a pair of traction wheels 7 at the rear of the frame. On the frame there are an operator's seat 8 and control instrumentalities for the operator, illustrated as comprising a steering wheel 9.

The drum 6, which is freely rotatable on a horizontal axis, extends substantially entirely across the frame. It will be understood that the roller incorporates a generally conventional vibratory mechanism (not shown) that comprises a rotatably driven eccentric mass by which oscillatory up and down forces are imposed upon the drum 6 so that the drum can in turn impose effective compacting forces upon surface traversed by the roller.

The traction wheels 7, as explained hereinafter, are rotatably driven for propulsion of the machine in addition to being steerable. The steering arrangement, described hereinafter, is such that the wheels 7 always remain in coaxial relationship to one another, even when they move up and down relative to one another and to the frame 5 to accommodate themselves to irregularities in the terrain. The wheels 7 are preferably equipped with rubber tires 10 that have a cleated or similar high traction tread. The wheels are axially spaced apart by a fairly substantial distance, but the distance between their axially remote faces is somewhat less than the axial length of the drum 6.

Figure 2:
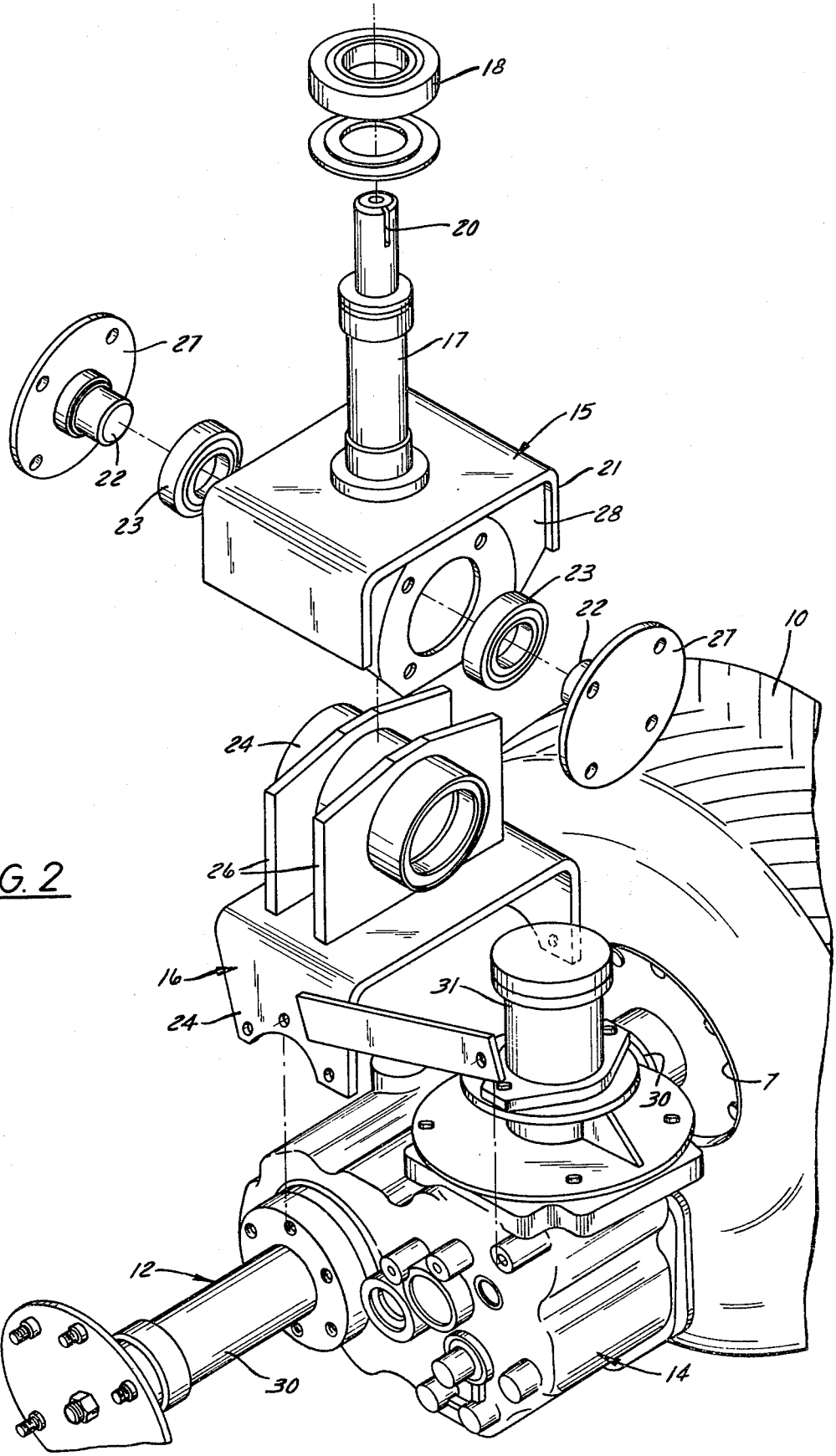
FIG. 2 is an exploded perspective view of the structure by which the wheels are connected with the frame for steering and for independent up and down motion to accommodate terrain irregularities and by which the wheels are rotatably driven for propulsion.

The structure by which the wheels 7 are connected with the frame 5 comprises (FIG. 2) axle means 12 to which the wheels are coaxially secured, an axle housing 14 in which the axle means 12 is rotatable, a generally upright steering bracket 15, and a connecting member 16 that provides a connection between the axle housing 14 and the steering bracket 15. The steering bracket 15, which is the element of the wheel supporting structure that is directly connected with the frame 5, provides for steering movements of the wheels, while the connecting member 16 cooperates with the steering bracket to support the axle housing 14 for swinging motion that allows the wheels 7 to move up and down relative to one another and to the frame 5.

The upper portion of the steering bracket 15 comprises a vertical shaft or post 17. Bearings 18, confined in a bearing support 19 that comprises a portion of the frame 5, receive the steering bracket post 17 to confine it to rotation about its vertical axis, which constitutes a steering axis for the wheel support structure. As denoted by a keyway 20 in the post or shaft 17, the steering bracket 15, is intended to be rotated from the steering wheel 9 through a linkage (not shown) which can be generally conventional.

The lower portion 21 of the steering bracket 15 has the form of a bottomless box, and an opposite pair of its side walls support a pair of coaxial stub shafts 22 that project inwardly towards one another to be received in coaxial bearings 23 that are supported by the connecting member 16. The stub shafts 22 define a swinging axis which is normal to the vertical steering axis and which extends more or less fore-and-aft relative to the frame 5 but swings with steering rotation of the steering bracket.

Figure 3:
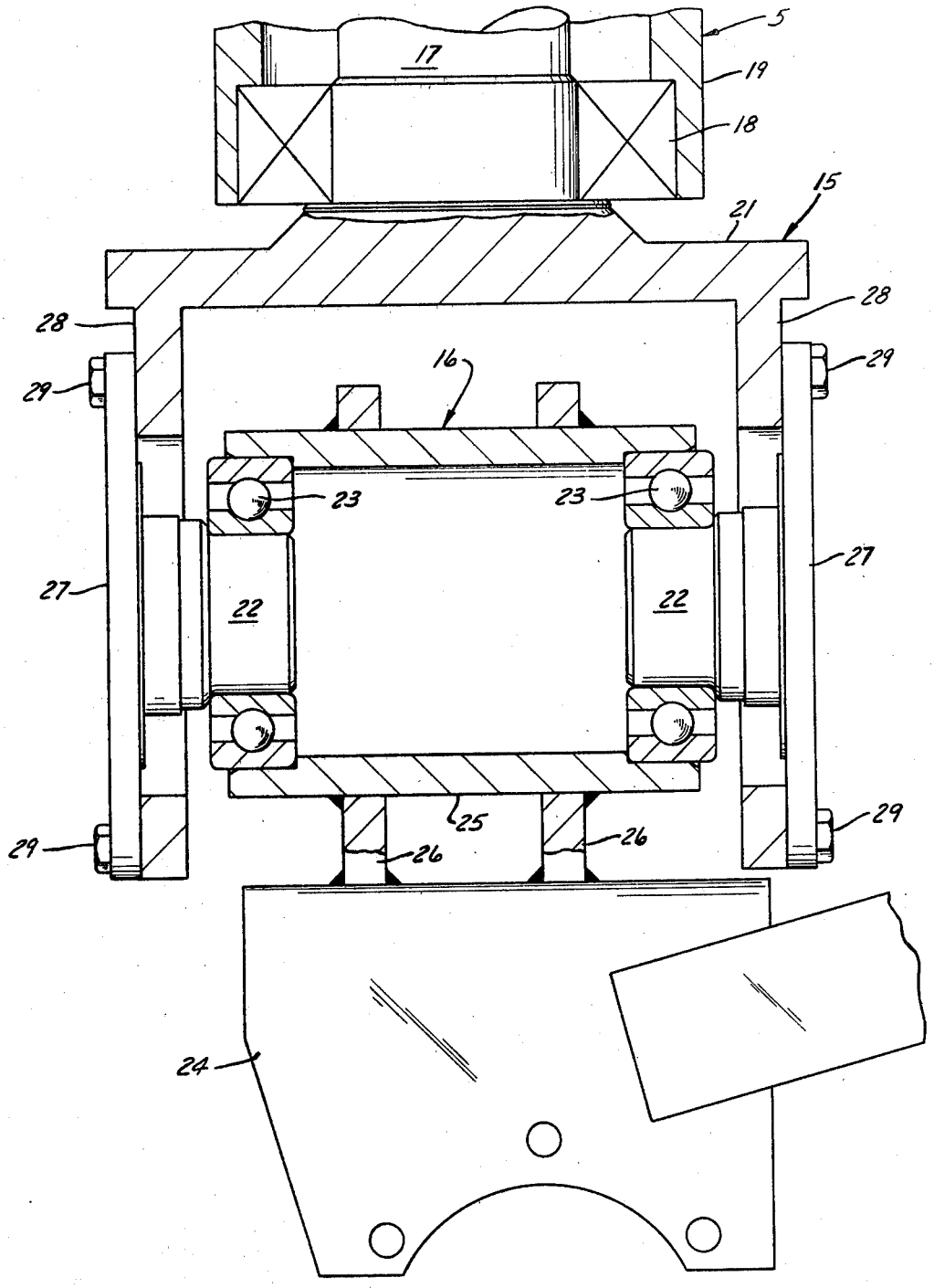
FIG. 3 is a fragmentary view in vertical section on a large scale, taken through the lower portion of the steering bracket and the pivotal connection between it and the axle housing.

The connecting member 16 has an inverted-U-shaped lower portion 24 that straddles the axle housing 14 and is rigidly secured thereto, so that in practical effect the connecting member comprises a part of the axle housing. The upper portion of the connecting member comprises a tubular bearing holder 25 that is secured to its lower portion by gib plates 26. As best seen in FIG. 3, the bore through the tubular bearing holder 25 has enlarged end portions in which the bearings 23 are closely received, and the stub shafts 22 are received in the inner races of those bearings 23, which are shown as ball bearings. The stub shafts 22 are concentrically secured to disc-like cap plates 27 which overlie the opposite side walls 28 of the box-like lower portion 21 of the steering bracket and are secured to them by means of bolts 29. The stub shafts 22 project into the bearings 23 through holes in the walls 28. It will be observed that the box-like bottom portion 21 of the bearing bracket serves as a protective cover that cooperates with the tubular bearing holder 25 of the connecting member to keep dirt out of the bearings 23.

The axle means 12 is preferably a transaxle comprising transmission and differential mechanism (not shown) that are within the axle housing 14. Coaxial portions 30 of the axle means that project from opposite sides of the axle housing 14 have the wheels 7 secured to their outer end portions in a generally conventional manner.

The axle housing 14 supports a drive motor 31 through which propulsion torque is applied to the axle means 12 and thus to the wheels 7. Although the drive motor 31 could be electric, it is preferably hydraulic. It will be understood that with a hydraulic drive motor 31, a pump and a hydraulic fluid reservoir (not shown) will be mounted on the frame 5 of the machine, and suitable hoses (also not shown) will extend between these and the motor.

It will be evident that the axle housing 14 and the drive motor 31 swing about the substantially horizontal swinging axis defined by the stub shafts 22, which axis is transverse to the axis of the wheels 7 and the axle means 12. The drive motor 31 as well as the axle housing 14 can thus partake of all swinging of the axle means 12 about the vertical steering axis and about the horizontal swinging axis, so that the propulsion drive transmission can be of a relatively simple type.

From the foregoing description taken with the accompanying drawings it will be seen that this invention provides a very maneuverable compacting roller having a cylindrical compacting drum at one end of its frame and a pair of propulsion and steering wheels near the other end of its frame, said steering wheels being coaxially secured to axle means that extend between them, and said axle means being swingable about a vertical steering axis, for steering, and also being swingable about a swinging axis which is mutually perpendicular to the wheel axis and the steering axis, to enable the wheels to move up and down relative to one another and the frame so that they can accommodate terrain irregularities. Since the drive motor for the wheels is fixed on an axle housing that swings about said axes with the axle means, that motor can be drivingly connected with the axle means through a relatively simple transmission.

What is claimed as the invention is:

1. A soil compacting roller comprising a frame and a cylindrical drum by which said frame is partially supported and by which compacting force is imposed upon a surface traversed by the roller, said drum being rotatable about a horizontal axis that extends transversely to the frame near one end thereof, said roller being characterized by:

A. a pair of wheels;

B. rotatable axle means to which said wheels are secured for coaxial rotation in axially spaced apart relationship;

C. an axle housing between said wheels in which said axle means is rotatable;

D. a drive motor carried by said axle housing and drivingly connected with said axle means to provide for propulsion of the roller;

E. a steering bracket connected with said frame near the other end thereof to pivot about a substantially vertical steering axis; and F. means providing a connection between said steering bracket and said axle housing whereby the latter is confined to swinging motion relative to said steering bracket about a substantially horizontal axis which is transverse to said common axis and between the wheels, so that the axle means is swingable up and down to enable the wheels to accommodate terrain irregularities but is constrained to pivot about said steering axis with the steering bracket to provide for steering of the roller.

2. The soil compacting machine of claim 1 wherein the distance between the axially remote faces of said wheels is less than the axial length of the drum.

3. A soil compacting roller having a substantially rigid frame and a compacting drum connected with said frame for rotation about a substantially horizontal axis, said roller further having a pair of propulsion wheels and drive mechanism by which said wheels are rotatably driven, said roller being characterized by:

A. an axle housing;

B. axle means confined to rotation relative to said axle housing and to which said wheels are drivingly connected to be maintained in coaxial spaced apart relationship at opposite sides of the axle housing;

C. pivot means connecting said axle housing with the frame and providing for swinging of the axle housing about a pair of axes which are mutually perpendicular to one another and to the axis of the wheels, (1) one of said pair of axes being a substantially vertical axis about which the axle housing is swingable for steering of the roller, (2) the other of said pair of axes being substantially horizontal and providing for up and down tilting of the axle means whereby both wheels are enabled to remain in contact with a surface notwithstanding irregularities therein; and D. said drive mechanism comprising a motor mounted on the axle housing so as to partake of swinging movements of the axle housing about said pair of axes.

4. A soil compacting roller comprising a frame, a cylindrical drum which is rotatable about a horizontal axis near one end of the frame and by which compacting force is imposed upon a surface traversed by the roller, and a pair of coaxial wheels which cooperate with said roller to support the frame and which provide for propulsion and steering of the roller, said soil compacting roller being characterized by:

A. a steering bracket connected with said frame to pivot relative thereto about a substantially vertical axis near the other end of the frame;

B. an axle housing;

C. axle means rotatable in said axle housing and having portions to which said wheels are respectively secured that project from said axle housing in opposite substantially horizontal directions and are confined to coaxial relationship;

D. swivel joint means providing a connection between said axle housing and said steering bracket whereby said axle housing is swingable relative to said steering bracket about a substantially horizontal axis which is transverse to the axis of said portions of the axle means and between said wheels, so that said portions can swing up and down as the wheels accommodate themselves to terrain irregularities; and E. a drive motor supported by said axle housing to partake of all motion thereof and drivingly connected with said axle means to rotatably drive the wheels for propulsion of the roller.

5. The soil compacting roller of claim 4 wherein said drive motor is a hydraulic motor.

* * * * *